United States Patent [19]

Ferry

[11] 3,995,249

[45] Nov. 30, 1976

[54] RESISTORS

[75] Inventor: Robert Ferry, Sunderland, England

[73] Assignee: Welwyn Electric Limited, England

[22] Filed: July 2, 1975

[21] Appl. No.: 592,380

[30] Foreign Application Priority Data

July 9, 1974 United Kingdom ..... 30359/74

[52] U.S. Cl. ..... 338/292; 323/94 R; 338/308; 338/309; 338/325; 338/314; 338/315; 338/320; 427/126

[51] Int. Cl.[2] ..... H01C 3/10

[58] Field of Search ..... 338/7–10, 338/260, 295, 283, 287, 292, 306, 307, 309, 308, 314, 320, 325; 427/123–126; 323/94 R

[56] References Cited

UNITED STATES PATENTS

| | | | |
|---|---|---|---|
| 3,344,387 | 9/1967 | Kinkel et al. | 338/308 X |
| 3,848,111 | 11/1974 | Brooneus | 338/308 X |

*Primary Examiner*—C. L. Albritton

*Attorney, Agent, or Firm*—McDougall, Hersh & Scott

[57] ABSTRACT

A precision electrical resistance network device comprising an electrically insulating substrate having at least two film electrical resistance elements supported thereon, the resistance elements having substantially the same temperature coefficient of resistance, characterized in that the device is constructed and arranged in such a way that temperature differences resulting through connection of the device in an electric circuit are minimized, which may be done by providing the substrate with heat transfer means through which heat can flow, so that a tendency for temperature differences in the film elements to occur is counteracted, and/or by twining and locating the resistance elements adjacent one another on the substrate, whereby the mean temperature of each element is substantially the same.

5 Claims, 2 Drawing Figures

RESISTORS

BACKGROUND

This invention relates to an electrical precision resistor network comprising two or more electrical resistance elements; it is especially, although not exclusively, applicable to voltage dividers. As used herein "electrical resistance elements" includes an arrangement where one resistance film is split into two or more portions by the interposition between the two ends of the film of one or more terminals for tapping off electricity.

It is often required to produce a network of film electrical resistance elements on a flat insulating substrate such that certain specified electrical parameters of each of said elements will retain a given relationship to those of all other said elements under a variety of different operating conditions including various ambient temperatures and at different levels of power loading. When this requirement is fulfilled, the resulting characteristic is referred to as "tracking" of resistance values; this characteristic is especially important, e.g., in the case of all of the elements in a precision voltage divider network or in so-called ladder networks where a series-connected chain of electrical resistance elements has a voltage applied to its ends and voltage division is achieved by tapping off the required voltage across one or more elements of the chain.

Attempts have been made to achieve satisfactory tracking of the elements by imparting to them substantially the same temperature coefficient of resistance and also arranging for the power loading per unit area of the elements to be constant, but these attempts have not been successful in obtaining precise tracking of the resistance elements.

One of the problems encountered, especially in the production of thin film resistance networks on insulating substrates, is that the surface of the substrate on which the resistance elements are deposited must be very smooth and substrates made from glass have been found useful in this respect. However, it has been found that with networks, e.g. voltage dividers, deposited onto glass substrates the problem of achieving satisfactory tracking of the elements in the network is particularly great.

We have found that in the known arrangement of a network of film electrical resistance elements on a flat insulating substrate, each element and/or parts of single elements if or are at different temperatures and it is this phenomenon which causes the inability to produce satisfactory tracking of resistance values.

SUMMARY

The present invention provides a precision electrical resistance network device comprising an electrically insulating substrate having at least two film electrical resistance elements supported thereon, the resistance elements having substantially the same temperature coefficient of resistance, the device being constructed and arranged in such a way that temperature differences resulting through connection of the device in an electric circuit are minimized. This minimizing of temperature differences may be achieved, e.g., by arranging portions of the film elements (this includes, of course, separate elements linked by one or more conductors) on the substrate in such a way that, during use, the temperature of the element portions tends to be equalized or equilibrated, and/or by providing the substrate with heat transfer means (e.g. a heat conducting layer) through which heat can flow, so that a tendency for temperature differences in the film element portions to occur is counteracted.

BRIEF DESCRIPTION OF THE DRAWINGS

The invention is described with reference to the accompanying diagrammatic drawings in which.

As indicated above, the minimum of two resistance elements may comprise at least two discrete films on the substrate; alternatively, they may comprise at least two parts of a single film provided with at least one tapping point.

In one embodiment, the two or more resistance elements are twined and located adjacent one another on the substrate in such a way that the mean temperature of each element is substantially the same. In this embodiment the resistance elements are preferably in the form of meandered tracks of resistive material to facilitate the production of high resistance values and thus facilitating the location of one element in close proximity to another, one resistance element being located to tend to equilibrate its average temperature with that of another resistance element.

In another embodiment, the substrate is provided with heat transfer means in thermo-conductive relation therewith, said means being of a material of higher thermal conductivity than that of the substrate. This heat transfer means may be a layer or sheet of metal of high thermal conductivity, e.g. copper or aluminium, or a metal or alloy of lower thermal conductivity than these, e.g. Kovar (Registered Trade Mark), in thermal contact with the major face of the substrate opposite to that having the resistance elements thereon. Alternatively, the metal layer or sheet may be in contact with that face of the substrate having the resistance elements thereon, a thin layer of electrically insulating material being disposed between the elements and the metal layer or sheet. Instead of a metal, a non-metallic material having high thermal conductivity, e.g. beryllium oxide may be used as heat transfer means.

By means of the heat transfer means, a substantially uniform temperature can be achieved over all parts of the substrate in contact with said means.

The two embodiments of the invention described above may be combined, so that the resistance elements are twined and located adjacent one another on a substrate having thereon heat transfer means such as a heat conductive layer.

The invention is especially applicable to substrates having low thermal conductivity, e.g. glass substrates, porcelain, steatite ceramic substrates, alumina ceramic substrates having a low alumina content and substrates of plastics materials.

An important use for the electrical resistance network of the invention is as a precision voltage divider network where precise tracking of the resistance elements forming the divider is required.

The film electrical resistance element may be any resistive material capable of being deposited onto a flat insulating substrate to form two or more resistance elements, examples being vacuum evaporated metals, chemically and conductive plastics materials, and other materials known in the art.

Figure 1:
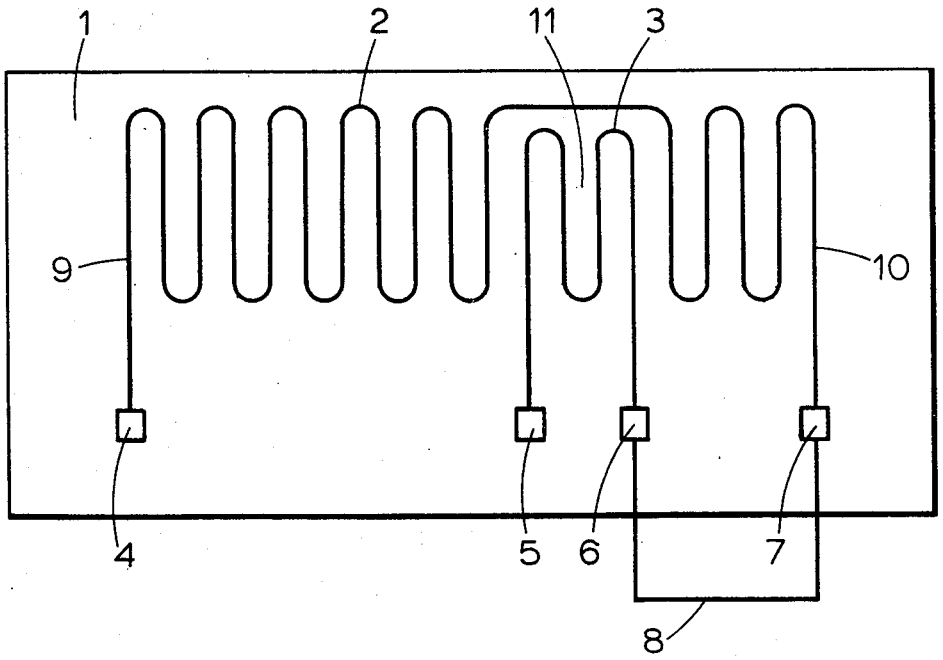
FIG. 1 shows a top plan view of one embodiment of the invention.

Referring to FIG. 1, a glass substrate 1 of low thermal conductivity (e.g. of the order of 1 watt per meter per degree Centigrade), such as glass type 7059 manufactured by Corning Glass Works, is provided with a first resistance element 2 and a second resistance element 3 located adjacent to and twined in relation to element 2. Elements 2 and 3 are in the form of meandered tracks and have substantially the same temperature coefficient of resistance and are suitably formed of the same electrical resistance material. The device shown in FIG. 1 is intended to be used as a voltage divider, especially for high voltage applications, and elements 2 and 3 are suitably of a nickel-chromium alloy deposited by a well-known technique (e.g. vacuum evaporation), an example of a suitable resistance value for element 2 being 9.9 megohms and that for element 3 being 100 kilohms. The resistance material may, for example, be deposited over the entire surface of the substrate 1 and the elements 2 and 3 subsequently produced using well-known photolithographic and etching techniques. Terminals 4, 5, 6 and 7 are provided at the ends of the elements 2 and 3, these terminals being, for example, gold plated to facilitate the attachment of external leads thereto by a technique such as welding or soldering.

When in use as a voltage divider, terminals 6 and 7 are connected together by means of an electrically conductive lead 8 so that elements 2 and 3 are connected in series; terminals 4 and 5 are connected to a voltage source and an output voltage is obtained by tapping off across element 3, connections being made to terminals 5 and 6 for this purpose.

The location of the element 3 relative to element 2 on the substrate 1 is of primary importance. Along the length of any resistance element deposited on a substrate of low thermal conductivity and subjected to electrical load, there is a temperature variation, the temperature being lowest at the ends adjacent the terminals and highest in the middle therebetween. At some position between the middle and each end is a region where the temperature is at a level corresponding to the mean for the whole element. If a voltage is applied between the terminals 4 and 5, the temperature of the elements 2 and 3 increases. The temperature of the element 2 is at the lowest value at ends 9 and 10 adjacent terminals 4 and 7 respectively and at the highest value half way along the length of the element between ends 9 and 10. The element 2 is meandered to form loops, one of which is shaped to accommodate all of the element 3; this loop, designated by reference numeral 11, is at a temperature whose value is the mean of said lowest and highest values. This arrangement ensures that the mean temperature of elements 2 and 3 will be substantially the same and when voltage division is effected by tapping off between terminals 5 and 6, the divider ratio will remain substantially the same regardless of the power loading involved. This satisfactory tracking of elements 2 and 3 results in a voltage divider network of great precision.

Figure 2:
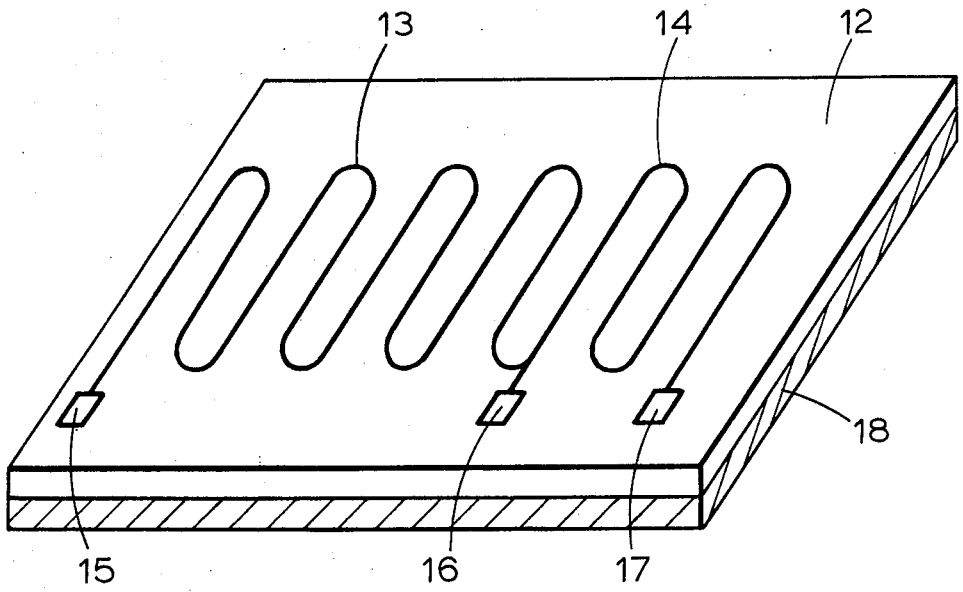
FIG. 2 shows a perspective view of another embodiment of the invention.

Referring now to FIG. 2, this illustrates an alternative embodiment of the invention involving another way of solving the problem of achieving satisfactory tracking of resistance elements. A glass substrate 12, e.g. Corning Glass Works type 7059, of low thermal conductivity is provided on its surface with a first resistance element 13 and a second resistance element 14 connected in series. These elements are formed as a single unit from the same resistance material and have substantially the same temperature coefficient of resistance. The device shown is intended to function as a voltage divider. The elements 13 and 14 are suitably formed of an alloy such as nickel-chromium, by a technique such as vacuum evaporation, the meandered track configuration being achieved by well-known photolithographic and etching techniques after depositing a nickel-chromium film over the entire surface of the substrate. Terminals 15, 16 and 17 are provided on the resistance elements 13 and 14; these are of the same material as the elements, but are metal plated, for example with gold, to enable terminal leads to be connected thereto by a technique such as welding. Heat transfer means is provided in the form of a sheet of aluminium or copper or beryllium oxide 18 which is in thermal contact with the major face of the substrate 12 opposite to that having the resistance elements deposited thereon. A thin film of an epoxy adhesive may be used to secure the sheet 18 to the substrate.

A voltage supply is connected to terminals 15 and 17 and voltage division is achieved by tapping off between terminals 16 and 17. The applied voltage causes a rise in temperature to take place in the elements 13 and 14. In the absence of sheet 18, the mean value of the temperature in each of these two elements would be different due to the low thermal conductivity of the substrate 12. Element 14, which is smaller than element 13 and is arranged towards the edge of the substrate, will not attain the same temperature as the larger element 13 which is spread over the major part of the substrate. Thus, in the absence of sheet 18, the resistance values of elements 13 and 14 will not track, despite the similarity of their temperature coefficient of resistance, and the voltage divider ratio will vary according to the power loading involved. The provision of the sheet 18 on the back of the substrate, which sheet 18 has very good thermal conductivity compared with the substrate 12 and conducts heat from the hottest regions of the substrate 12 to the coolest regions, enables all parts of the substrate to attain substantially the same temperature and with the result that the mean temperature of each of the elements 13 and 14 is substantially the same, so that the resistance values of elements 13 and 14 will track regardless of the power loading involved.

If desired, heat transfer means, such as the sheet 18 described with reference to FIG. 2, may be applied to the embodiment described with reference to FIG. 1, thus improving tracking even further.

Although the specific embodiments described above and shown in FIGS. 1 and 2 refer to voltage divider networks, the invention is not limited to such networks and may be applied to other networks or circuits where the resistance values of two or more elements deposited on an insulating substrate are required to track.

Although the present invention is described herein with particular reference to specific details, it is not intended that such details shall be regarded as limitations upon the scope of the invention except insofar as included in the accompanying claims.

I claim:

1. A precision electrical resistance network device comprising an electrically insulating substrate having at least two film electrical resistance elements supported thereon, the resistance elements having substantially the same temperature coefficient of resistance, characterized in that one of said resistance elements is arranged in the form of a meandered track having a plurality of convolutions, space being provided between two adjacent convolutions to accommodate at least the major part of at least one additional resistance element, whereby the mean temperature of each element is substantially the same.

2. A device according to claim 1, in which said substrate is provided with heat transfer means in thermoconductive relation therewith, said means being of a material of higher thermal conductivity than that of the substrate.

3. A device according to claim 1, in which said substrate is selected from glass substrates, porcelain, steatite ceramic substrates, alumina ceramic substrates having a low alumina content and substrates of plastic materials.

4. A device according to claim 3, in which said substrate is provided with heat transfer means in thermoconductive relation therewith, said means being of a material of higher thermal conductivity than that of the substrate.

5. A device according to claim 2, in which said substrate is selected from glass substrates, porcelain, steatite ceramic substrates, alumina ceramic substrates having a low alumina content and substrates of plastic materials.

* * * * *